United States Patent [19]

Fournier

[11] 4,276,723

[45] Jul. 7, 1981

[54] COMPENSATING STEADYREST

[75] Inventor: Roger H. Fournier, Millbury, Mass.

[73] Assignee: The Warner & Swasey Company, Cleveland, Ohio

[21] Appl. No.: 82,519

[22] Filed: Oct. 9, 1979

[51] Int. Cl.[3] ..... B24B 41/06

[52] U.S. Cl. ..... 51/238 S

[58] Field of Search ..... 51/238 R, 238 S, 236 R

[56] References Cited

U.S. PATENT DOCUMENTS

| | | | |
|---|---|---|---|
| 2,160,378 | 5/1939 | Balsiger | 51/238 S |
| 2,838,885 | 6/1958 | Cann | 51/238 S |
| 3,145,513 | 8/1964 | Porath | 51/238 S |
| 3,427,762 | 2/1969 | Mills | 51/238S |
| 3,591,988 | 7/1971 | Price | 51/238 |
| 3,736,114 | 5/1973 | Okada | 51/238 S |
| 3,878,651 | 4/1975 | Nakada | 51/238 S |

FOREIGN PATENT DOCUMENTS

| | | | |
|---|---|---|---|
| 764493 | 12/1956 | United Kingdom | 51/238 S |

*Primary Examiner*—Harold D. Whitehead
*Attorney, Agent, or Firm*—Howard G. Massung

[57] ABSTRACT

A steadyrest for supporting a workpiece to be ground comprising three contact shoes which are simultaneously movable toward and away from a workpiece centerline so that workpieces of varying diameter can be supported and maintained on a fixed centerline of rotation. The top contact shoe is mounted for pivotal movement to a position clear of the work area to facilitate loading and unloading of the workpiece. A hydraulic operator is provided for pivoting the upper contact shoe between the operative position, engaging a workpiece, and the load-unload position. A second hydraulic operator is provided which through appropriate mechanical wedges moves upper contact shoe and the two lower non-pivoting contact shoes simultaneously toward or away from a workpiece.

8 Claims, 7 Drawing Figures

COMPENSATING STEADYREST

BACKGROUND OF THE INVENTION

1. Field of the Invention

This invention relates to a workpiece steadyrest and more particularly to a three-contact point workpiece steadyrest wherein all the contact shoes are simultaneously movable.

2. Description of the Prior Art

Presently most cam grinding machines utilize workpiece steadyrests having contact shoes which are set at a fixed position. In these prior art cam shaft steadyrests the fixed contact shoes are set to support a main bearing having a maximum within tolerance outer diameter. Cam shafts having main bearings of a smaller diameter are loose in the steadyrest, while cam shafts having over-tolerance main bearings are marked due to excessive gripping pressure and/or have their cams ground improperly.

U.S. Pat. No. 3,736,114 shows a steadyrest having three simultaneously movable contact shoes for engaging a workpiece. The main body of the steadyrest has a bore which receives a rotatable sleeve. A shaft is slidably contained in the sleeve and moved axially as the sleeve rotates. The center steadyrest shoe is provided at the free end of the shaft. The upper and lower contact shoes are pivotally mounted on the main body and are responsive to rotation of the sleeve for movement toward and away from the workpiece.

SUMMARY OF THE INVENTION

The present invention teaches a compensating steadyrest providing three contact point support for various diameter workpieces. The three point support is provided by three contact shoes which contact the workpiece and are simultaneously movable to move the contact points toward the workpiece centerline. The top contact shoe is supported on a pivot arm and can be moved clear of the workpiece area to facilitate loading and unloading of the workpiece. The disclosed steadyrest can clamp and center parts having different diameters. The steadyrest can grip an oversized main bearing. The main bearing on a cam shaft can be ground while being gripped by the steadyrest and the steadyrest will follow the diameter of the main bearing as it is ground down. The lower two contact shoes are attached to a movable contact shoe support member. The contact shoe support member is movable radially toward the workpiece centerline. Guides are provided to maintain the proper orientation of the contact shoe support member. The lower two contact shoes are adjustably connected to their support member to vary the range of diameters over which the steadyrest can operate.

During operation, the contact points on the lower support shoes can change as a function of the diameter of the part being supported. In grinding a cam shaft the main bearing makes point contact with the steadyrest shoes. The two lower contact shoes move as a unit and while their shoe faces do not move directly toward the main bearing centerline, the contact points do. The lower contact shoe support and the shoe faces are sized to cover the range of diameters to be supported. Adjustments are provided for changing the range over which the steadyrest operates.

A first hydraulic actuator is provided for moving the pivot arm and the connected upper contact shoe between the working position and the loading position.

When the upper contact shoe is in the working position the three contact shoes are simultaneously movable to support workpieces of various diameters. A second hydraulic actuator is provided for moving a pair of actuator wedges. The pair of actuator wedges are connected to move the workpiece contact points simultaneously toward the centerline of the workpiece. The wedges have different wedge angles so that radial movement of the contact points toward the workpiece centerline is essentially the same. The hydraulic pressure applied to the second hydraulic actuator determines the force which the steadyrest exerts on the workpiece. The pressure is selected to be high enough to firmly support the workpiece, but low enough so the workpiece is not marked.

Fine adjustments are provided for positioning the pair of actuator wedges and their associated contact shoes. A locking wedge is provided for locking the steadyrest to the member from which the workpiece is supported.

BRIEF DESCRIPTION OF THE DRAWINGS

For a better understanding of the invention, reference may be had to the preferred embodiment exemplary thereof shown in the accompanying drawings wherein.

DESCRIPTION OF THE PREFERRED EMBODIMENT

Figure 1:
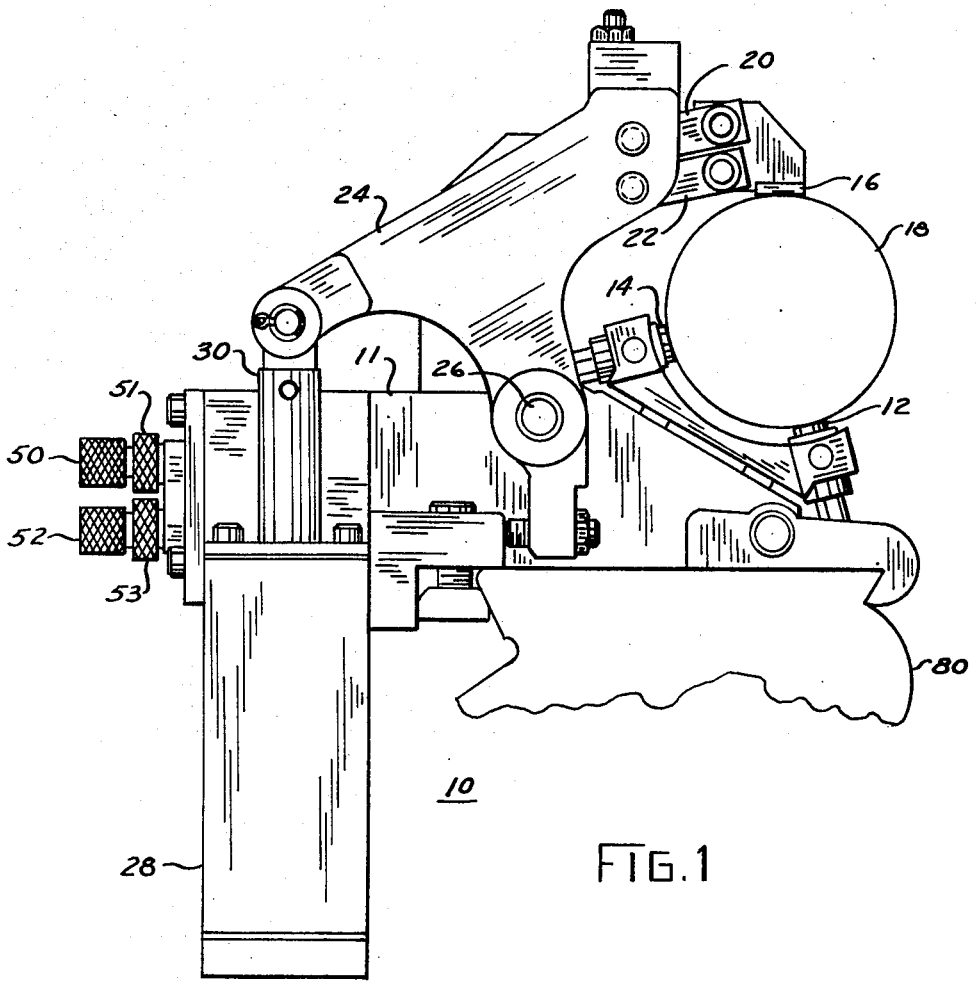
FIG. 1 is a side view of a workpiece steadyrest constructed in accordance with the teaching of the present invention.
Figure 2:
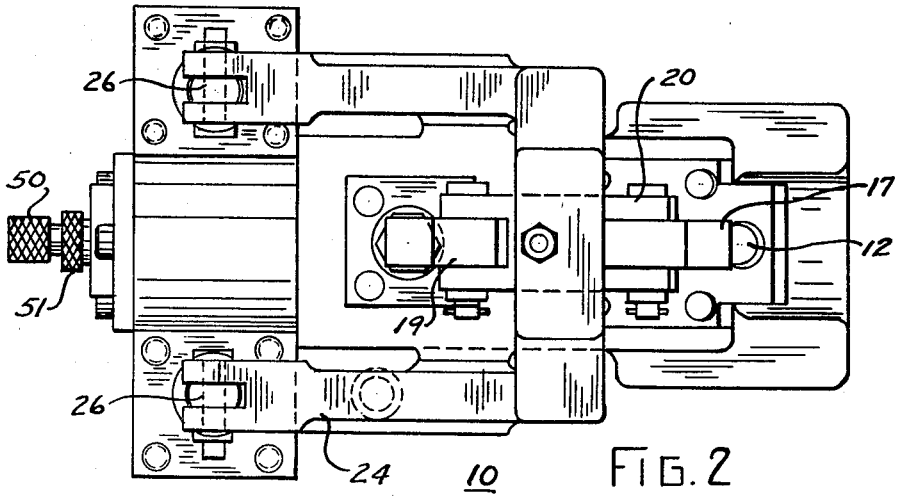
FIG. 2 is a top view of the steadyrest of FIG. 1.
Figure 3:
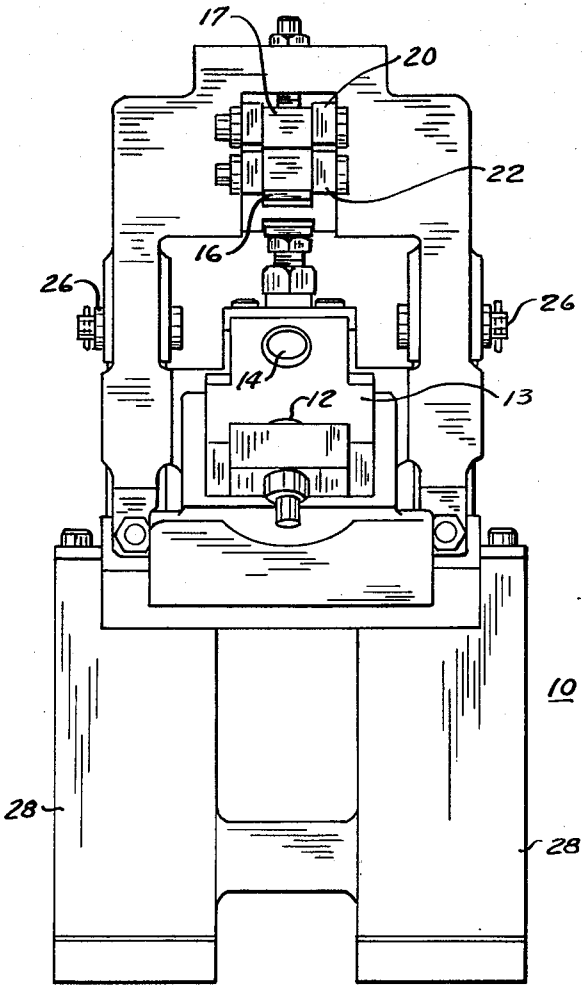
FIG. 3 is a view from the right hand side of the steadyrest shown in FIG. 1.
Figure 4:
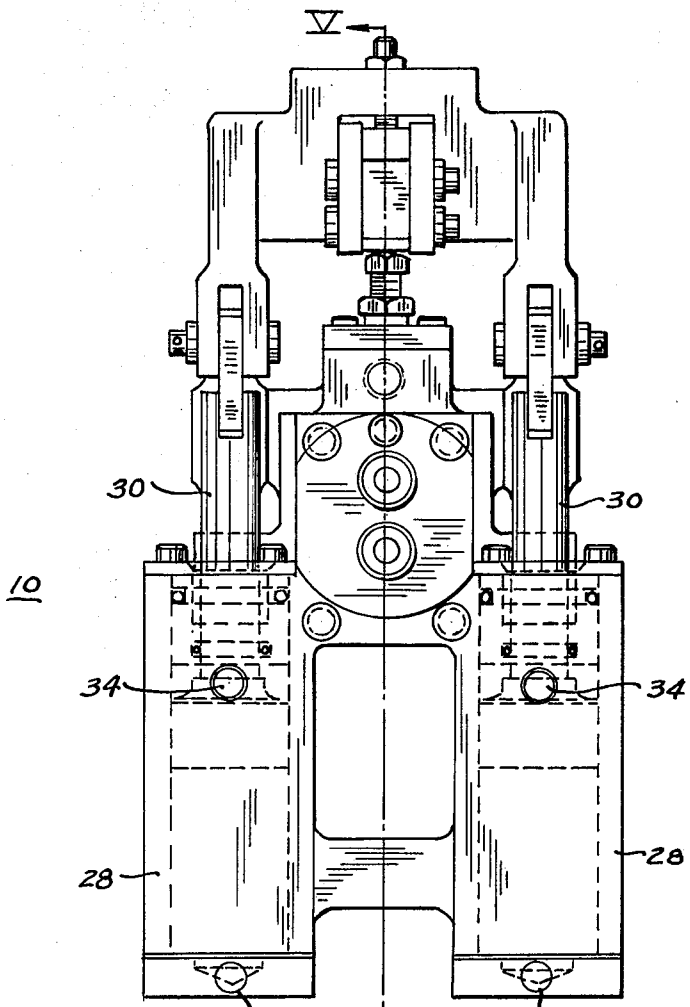
FIG. 4 is a view from the left hand side of the steadyrest shown in FIG. 1.
Figure 6:
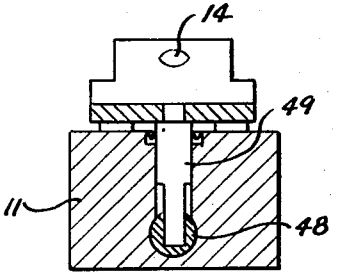
FIG. 6 is a section view of a portion of the steadyrest taken along line VI—VI of FIG. 5.
Figure 7:
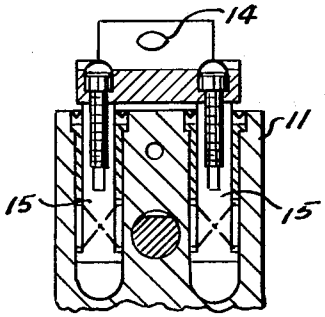
FIG. 7 is a section view of a portion of the steadyrest taken along the line VII—VII of FIG. 5.

Referring now to the drawings, there is shown a compensating steadyrest 10, constructed according to the teaching of the present invention. Steadyrest 10 is particularly suitable for supporting the main bearing on cam shafts during cam grinding. Compensating steadyrest 10 utilizes three contact shoes 12, 14, and 16 to contact and support the cam shaft blank during grinding. Contact shoes 12, 14, 16 are movable simultaneously to move the contact support points toward the axis of rotation of a workpiece 18. Steadyrest 10 comprises a main body portion 11 in which is formed a hydraulic cylinder and piston 40. Mechanical interconnections are provided for controlled simultaneous movement of the contact shoes 12, 14, 16 when the hydraulic piston 40 is moved. The hydraulic pressure applied to piston 40 determines the force with which the contact shoes 12, 14, 16 engage the workpiece. The top contact shoe 16 is mounted to pivot out of the work area to facilitate handling of the workpiece. Contact shoes 12, 14, 16 are generally flat so they make line contact with the supported workpiece.

Top contact shoe 16 is mounted to be pivoted clear of the workpiece area for loading and unloading workpiece 18. Upper contact shoe 16 is mounted from an end link 17 which is pinned to a pair of parallel links 20 and 22. The opposite ends of links 20, 22 are pinned to link 19 forming a four bar linkage which maintains links 17 and 19 parallel. Parallel links 20, 22 each have bifurcated ends for connecting to links 17, 19. The pair of parallel links 20 and 22 are pinned to pivot arm 24.

Pivot arm 24 is supported for pivotal movement about pivot axis 26. Pivot arm 24 includes a pair of rearward extending bifurcations which are utilized for moving pivot arm 24 around pivot connections 26. The rearward extending bifurcations are engaged by a pair of hydraulic actuators 28. Pivot arm 24 can be moved between an inoperative position, for loading and unloading workpieces 18, and an operating position, for supporting a workpiece 18 during grinding. Hydraulic actuators 28 when extended move pivot arm 24 to a position as shown in FIG. 1 for supporting a workpiece during grinding. When the operating rods 30 which extend from hydraulic actuators 28 are retracted, pivot arm 24 moves to swing contact shoe 16 away from the work area.

Pivot arm 24 is moved to the operating position by the introduction of pressurized hydraulic fluid at ports 32 while venting hydraulic fluid through ports 34. Pivot arm 24 is moved to the load position by the introduction of pressurized hydraulic fluid through ports 34 while venting hydraulic fluid through ports 32.

Figure 5:
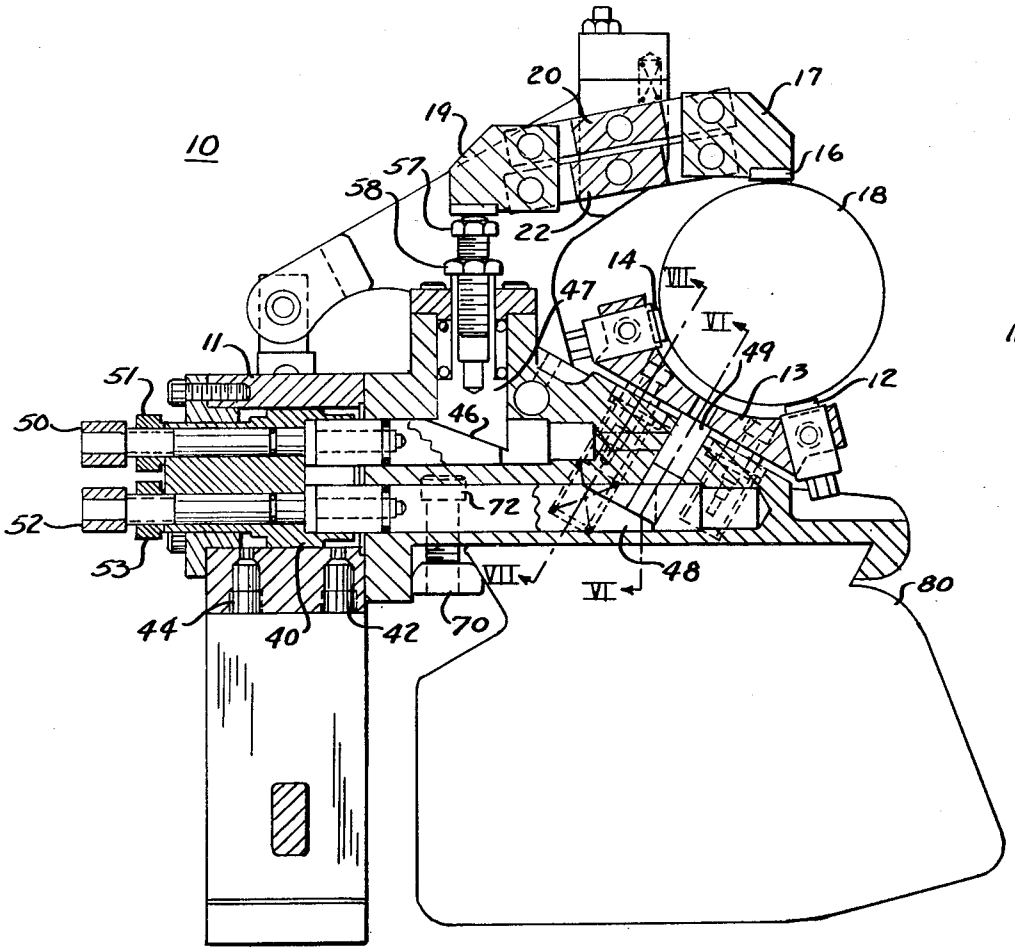
FIG. 5 is a view of the steadyrest of FIG. 4 taken along line V—V.

A contact shoe hydraulic actuator piston 40 is provided for causing simultaneous movement of contact shoes 12, 14, and 16. As best seen in FIG. 5, the introduction of pressurized hydraulic fluid through port 42 moves piston 40 to the left and the introduction of pressurized hydraulic fluid in port 44 moves hydraulic piston 40 to the right. Piston 40 is connected to move an upper actuator wedge and a lower actuator wedge 48. As piston 40 moves, upper actuator wedge 46 and lower actuator wedge 48 are unitarily movable therewith. An upper actuator wedge adjusting knob 50 is provided for adjusting the position of upper actuator wedge 46 with respect to piston 40. A lower adjusting knob 52 is provided for adjusting the position of the lower actuating wedge 48 with respect to piston 40. Upper adjusting knob 50 is connected by a threaded shaft to wedge 46. Wedge 46, which is held so it does not rotate, is longitudinally positioned with respect to piston 40 as knob 50 is rotated. A lock nut 51 is provided for locking knob 50 in a selected position. Lower adjusting knob 52 and lock nut 53 function similarly, for fine positioning of wedge 48 with respect to piston 40.

Wedge followers 47 and 49 are provided for following the movement of wedges 46 and 48 respectively. Wedges 46 and 48 are formed as slots in round members. Followers 47 and 48 have machined down portions which fit in these slots to follow the wedge surfaces. Wedge followers 47, 49 are spring biased into engagement with wedge surfaces 46, 48.

A lower contact shoe support is connected to follower 49 for movement therewith. Contact shoes 12 and 14 are adjustably secured to lower contact shoe support 13. Contact shoes 12 and 14 can be moved in or out with respect to support 13 for changing the range of diameters to be supported by steadyrest 10. A locking screw or nut is provided for locking contact shoe 12 or 14 in a desired position. Four guides 15 extend from support 13 into openings in the body 11 of steadyrest 10 for maintaining proper orientation. Guides 15 prevent movement of support 13 about the axis extending through follower 49. As piston 40 moves to the right, as viewed in FIG. 5, lower support 13 moves toward the workpiece and as piston 40 moves to the left lower support 13 moves away from the workpiece.

Follower 47 follows movement of wedge 46 for positioning upper contact shoe 16 when member 24 is in the work position. Adjusting bolt 57 engages the bottom of link 19 for coarse adjustment of upper shoe 16 with respect to piston 40. A lock nut 58 is provided for locking bolt 57 in position. The bottom of link 19 is maintained parallel to shoe 16 as the head of bolt 57 engages and moves link 19. As piston 40 moves to the right, as viewed in FIG. 5, contact shoe 16 moves toward the workpiece and as piston 40 moves to the left contact shoe 16 moves away from the workpiece.

During use in supporting a cam shaft, steadyrest 10 is secured to the rocking bar 80. A locking wedge 70 is pulled into engagement with rocking bar 80 by bolt 72 to firmly secure steadyrest 10 to rocking bar 80 in a position to support the main bearing of a cam shaft.

I claim:

1. A steadyrest for supporting various diameter workpieces for rotation about a common centerline comprising:

a main body member;

three flat contact shoes each movable with respect to said main body member for engaging along a line contact and supporting a workpiece;

pivot means pivotally connected to said main body member for supporting an upper one of said three contact shoes and being operable to pivot the supported contact shoe between a load position, remote from the work area, and an operation position, in the work area, for engaging the workpiece;

a hydraulic cylinder formed in said main body member;

a piston disposed in said hydraulic cylinder and being movable in response to the application of pressurized hydraulic fluid;

a first wedge connected to said piston for movement therewith;

a second wedge connected to said piston for movement therewith;

a first wedge follower for following the movement of said first wedge;

a second wedge follower for following the movement of said second wedge;

upper contact shoe positioning means disposed between said upper one of said contact shoes and said first wedge for positioning said upper contact shoe in response to movement of said first wedge;

a lower contact shoe support supporting two of said three contact shoes;

lower contact shoe positioning means disposed between said lower contact shoes and said lower wedge follower for positioning said lower contact shoes as said lower wedge is moved;

said upper and lower contact shoe positioning means operable when said pivot means is in the operating position for simultaneously and at the same rate moving the line contact of each of said three contact shoes into engagement with the workpiece for supporting workpieces of various diameter for rotation about the common centerline.

2. A steadyrest as claimed in claim 1 wherein said pivot means comprises:

an upper contact shoe support pivotally connected to said main body member and supporting one of said three contact shoes; and, a hydraulic operator connected to said upper contact shoe support for pivoting said upper contact shoe support about its pivot connection to said main body member.

3. A steadyrest as claimed in claim 1 comprising: p1 coarse upper shoe adjusting means disposed between said upper contact shoe and said first wedge for adjusting the position of said upper contact shoe with respect to said first wedge; and, lower contact shoe coarse adjusting means disposed between said lower contact shoes and said second wedge for positioning said pair of lower contact shoes with respect to said lower wedge.

4. A steadyrest as claimed in claim 3 comprising:

fine upper contact shoe adjusting means for adjusting the position of said first wedge with respect to said piston; and, lower fine adjusting means for adjusting the position of said second wedge with respect to said piston.

5. A steadyrest for supporting a main bearing of a cam shaft from a rocking bar comprising:

a main body member;

a cylinder formed in said main body member;

a piston disposed in said cylinder and movable within said cylinder in response to the application of hydraulic fluid;

a pair of wedges connected to said piston and being movable therewith;

a pair of wedge followers one associated with each of said pair of wedges for following movement thereof;

a four bar linkage having one link connected for movement with one of said pair of wedge followers and an opposite link supporting an upper contact shoe;

a lower contact shoe support member supporting a pair of lower contacts;

means connecting said lower contact shoe support member for movement with the other of said pair of wedge followers.

6. A steadyrest as claimed in claim 5 comprising:

coarse adjusting means for adjusting the position of said contact shoes with respect to said wedge followers.

7. A steadyrest as claimed in claim 6 comprising:

fine contact shoe adjusting means for adjusting the position of said pair of wedges with respect to said piston.

8. A steadyrest as claimed in claim 5 comprising:

a pivot arm pivotally connected to said main body member;

an upper contact supported from said pivot arm;

a hydraulic operator for pivoting said pivot arm about said main body member.

* * * * *